US006187731B1

(12) United States Patent
Moeller et al.

(10) Patent No.: US 6,187,731 B1
(45) Date of Patent: Feb. 13, 2001

(54) CLEANING COMPOSITIONS FOR HARD SURFACES CONTAINING NAPHTHALENE SULFONIC ACID/FORMALDEHYDE CONDENSATES

(75) Inventors: Thomas Moeller, Duesseldorf; Heinz-Dieter Soldanski, Essen; Stefanie Kuech, Ratingen; Juergen Noglich, Duesseldorf, all of (DE)

(73) Assignee: Henkel Kommandigesellschaft Auf Aktien (KGaA), Duesseldorf (DE)

( * ) Notice: Under 35 U.S.C. 154(b), the term of this patent shall be extended for 0 days.

(21) Appl. No.: 09/470,517

(22) Filed: Dec. 22, 1999

(30) Foreign Application Priority Data

Dec. 23, 1998 (DE) ..... 198 59 640

(51) Int. Cl.[7] ..... C11D 17/00

(52) U.S. Cl. ..... 510/219; 510/238; 510/428; 510/432; 510/492; 510/506

(58) Field of Search ..... 510/218, 219, 510/428, 432, 492, 506, 238

(56) References Cited

U.S. PATENT DOCUMENTS

| | | | | |
|---|---|---|---|---|
| 3,696,043 | | 10/1972 | Labarge et al. | 252/153 |
| 3,839,234 | | 10/1974 | Roscoe | 252/544 |
| 3,882,038 | | 5/1975 | Clayton et al. | 252/164 |
| 3,969,258 | * | 7/1976 | Carandang et al. | 252/106 |
| 5,372,741 | * | 12/1994 | Tomaszewski et al. | 252/156 |

FOREIGN PATENT DOCUMENTS

| | | |
|---|---|---|
| 22 20 540 | 11/1973 | (DE) . |
| 0 344 847 | 12/1989 | (EP) . |
| 0 393 772 | 10/1990 | (EP) . |
| WO96/04358 | 2/1996 | (WO) . |
| WO96/04940 | 2/1996 | (WO) . |
| WO97/33963 | 9/1997 | (WO) . |
| WO97/38076 | 10/1997 | (WO) . |

* cited by examiner

*Primary Examiner*—Necholus Ogden
(74) *Attorney, Agent, or Firm*—Wayne C. Jaeschke; Daniel S. Ortiz; Glenn E. J. Murphy

(57) ABSTRACT

Naphthalene sulfonic acid/formaldehyde condensates (i) may be used in a composition for cleaning hard surfaces to reduce the rain effect and/or the film effect, (ii) may be present in a cleaning composition for hard surfaces in combination with one or more other anionic and/or nonionic surfactants and (iii) may be used in a process for reducing the rain effect and/or the film effect on a hard surface treated with a liquid cleaning composition, the surface being treated with a liquid cleaning composition in concentrated or diluted form containing one or more naphthalene sulfonic acid/formaldehyde condensates.

17 Claims, No Drawings

CLEANING COMPOSITIONS FOR HARD SURFACES CONTAINING NAPHTHALENE SULFONIC ACID/FORMALDEHYDE CONDENSATES

FIELD OF THE INVENTION

This invention relates to water-based, liquid, surfactant-containing compositions containing naphthalene sulfonic acid/formaldehyde condensate for cleaning hard surfaces, more particularly glass, to the use of naphthalene sulfonic acid/formaldehyde condensate in compositions for cleaning hard surfaces and to a process for treating hard surfaces with cleaning compositions containing naphthalene sulfonic acid/formaldehyde condensate.

BACKGROUND OF THE INVENTION

The cleaning compositions typically used nowadays for cleaning hard surfaces are generally aqueous preparations in the form of a stable solution or dispersion which contain surfactants, organic solvents and optionally complexing agents for the hardness constituents of water, abrasives and alkalis with a cleaning effect as their key active ingredients. Cleaning compositions intended above all for cleaning glass and ceramic surfaces are often formulated as solutions of the active ingredients in a mixture of water and water-miscible organic solvents, primarily lower alcohols and glycol ethers. Examples of such compositions can be found in DE-OS 22 20 540, in U.S. Pat. Nos. 3,389,234 and 3,882,038 and in European patent applications 344 847 and 393 772.

So far as their practical application is concerned, the cleaning compositions are expected to combine high cleaning performance with simple and convenient application. In most cases, the compositions are expected to develop the required effect after a single application, i.e. in the absence of further measures. Difficulties arise here—above all where the compositions are applied to smooth surfaces, particularly to reflective surfaces, such as glass or ceramic surfaces—out of the fact that compositions which have a favorable cleaning performance generally do not dry without leaving streaks while compositions which dry largely without any visible residues have only a limited cleaning effect. In order to combine an adequate cleaning effect, particularly against fatty soils, with acceptable residue behavior, relatively large quantities of more or less volatile alkalis have to be added to the cleaning compositions in addition to organic solvents. Ammonia and alkanolamines in particular have been used for this purpose. Unfortunately, relatively high concentrations of ammonia or amine—apart from the strong odors they emit—produce a corresponding increase in the pH value of the cleaning solution with the result that relatively sensitive surfaces, for example paint surfaces, are clearly attacked by these cleaning compositions.

In addition, smooth surfaces, particularly reflective surfaces, such as glass or ceramic surfaces, present two particular problems which generally do not come to light immediately after cleaning, but only at a later stage. The first problem is the well-known, but problematical phenomenon of the condensation of water onto the surfaces mentioned, for example in bathrooms during and after showering or bathing, which is referred to hereinafter as the film effect. The second problem is the phenomenon as well-known as it is unwelcome—although unavoidable in the long term—that, after the cleaning of a reflective surface exposed to the weather, such as window glass, a shower of rain destroys the cleaning result through the rain marks it leaves behind, which is referred to hereinafter as the rain effect.

Accordingly, there is still a need for cleaning compositions which have a high cleaning performance without any of the disadvantages mentioned above.

WO 96/04358 A1 (Procter & Gamble) describes cleaning compositions which are capable of cleaning glass without leaving behind any troublesome stains and/or films and which contain an effective quantity of a substantive polymer containing hydrophilic groups which provides the glass with relatively high and long-lasting hydrophilia, so that, the next three times at least the glass is wetted, for example by rain, the water drains from the glass surface and few stains are left behind after drying. Substantive polymers are, in particular, polycarboxylates, such as poly(vinyl pyrrolidone-co-acrylic acid), but also poly(styrene sulfonate), cationic sugar and starch derivatives and block copolymers of ethylene oxide and propylene oxide, the latter polyethers in particular having relatively little substantivity.

BRIEF DESCRIPTION OF THE INVENTION

It has now surprisingly been found that this problem is solved by the use of naphthalene sulfonic acid/formaldehyde condensate.

In a first embodiment, the present invention relates to the use of one or more naphthalene sulfonic acid/formaldehyde condensates in a composition for cleaning hard surfaces to reduce the rain effect and/or the film effect.

In a second embodiment, the present invention relates to a surfactant-containing composition for cleaning hard surfaces which contains one or more naphthalene sulfonic acid/formaldehyde condensates.

In a third embodiment, the present invention relates to a process for reducing the rain effect and/or the film effect on a hard surface treated with a liquid cleaning composition, the surface being treated with a liquid cleaning composition in concentrated or diluted form containing one or more naphthalene sulfonic acid/formaldehyde condensates.

A particular advantage of the present invention is that both an anti-rain effect and an anti-film effect are developed through naphthalene sulfonic acid/formaldehyde condensate. In addition, these condensates may readily be incorporated in the cleaning compositions in a clear and storage-stable form.

DETAILED DESCRIPTION OF THE INVENTION

Throughout the present specification, quantities are expressed as % by weight and are based on the composition as a whole, unless otherwise specifically stated.

The content of one or more naphthalene sulfonic acid/formaldehyde condensates in the composition according to the invention is from 0.001 to 20% by weight, preferably from 0.01 to 10% by weight, more preferably from 0.05 to 5% by weight, most preferably from 0.1 to 2.5% by weight and, in one particularly advantageous embodiment, from 0.2 to 2.0% by weight.

Naphthalene sulfonic acid/formaldehyde condensates are polycondensation products of naphthalene sulfonic acid and formaldehyde which may be obtained by known methods of alkaline or acidic condensation.

In the context of the present invention, the term naphthalene sulfonic acid/formaldehyde condensate encompasses the naphthalene sulfonate/formaldehyde condensates, i.e. the salts of the naphthalene sulfonic acid/formaldehyde condensates. Suitable salts are, for example, the alkali metal and alkaline earth metal salts, preferably the sodium, potassium, magnesium and calcium salts and the ammonium salts of the naphthalene sulfonic acid/formaldehyde condensates or mixtures thereof, more particularly the sodium salts.

Both high molecular weight and low molecular weight naphthalene sulfonic acid/formaldehyde condensates are suitable for the purposes of the invention, the low molecular weight condensates being marginally preferred.

Naphthalene sulfonic acid/formaldehyde condensates suitable for the purposes of the invention are commercially obtainable, for example under the name of Lomar® from Henkel Corp., for example the low molecular weight sodium salts Lomar® LS, Lomar® PW, Lomar® PWFA 40 and Lomar® PL 4, the high molecular weight sodium salts Lomar® D and Lomar® D SOL, the potassium salt Lomar® HP and the ammonium salt Lomar® PWA, and under the name of Tamol® from BASF AG, for example the low molecular weight condensates Tamol® NN 2901, Tamol® NN 7718, Tamol® NN 8906, Tamol® NN 9104, Tamol® NN 9401 (all sodium salts) and Tamol® NNA 4019 (ammonium salt) with a molecular weight of about 6,500 g/mole, the medium molecular weight condensates Tamol® NMC 4001 and Tamol® NN 9401 (both calcium salts) with a molecular weight of about 20,000 g/mole and the high molecular weight condensates Tamol® NH 3091, Tamol® NH 7519, Tamol® NH 9103 (all sodium salts) and Tamol® NHC 3001 (calcium salt) with an average molecular weight of about 35,000 g/mole.

In one particular embodiment of the composition according to the invention, the use according to the invention and the process according to the invention, at least one naphthalene sulfonic acid/formaldehyde condensate is used together with at least one other additive which also reduces the rain and/or film effect. Other additives in the context of this particular embodiment are in particular (i) the substantive polymers containing hydrophilic groups according to WO 96/04358 A1 (Procter & Gamble), more particularly polycarboxylates, such as poly(vinyl pyrrolidone-co-acrylic acid), but also poly(styrene sulfonate), cationic sugar and starch derivatives and block copolymers of ethylene oxide and propylene oxide, with an average molecular weight of 10,000 to 3,000,000 g/mole, preferably 20,000 to 2,500,000 g/mole, more preferably 300,000 to 2,000,000 g/mole and most preferably 400,000 to 1,500,000 g/mole, (ii) the amine oxide polymers, more particularly poly(4-vinylpyridine-N-oxides), according to WO 97/33963 A1 (Procter & Gamble) with an average molecular weight of 2,000 to 100,000 g/mole, preferably 5,000 to 20,000 g/mole and more preferably 8,000 to 12,000 g/mole, (iii) end-capped polyalkoxylated alcohols corresponding to formula:

$$R^1O(CH_2CH(CH_3)O)_p(CH_2CH(R^2)O)_qR^3.$$

in which $R^1$ is a linear aliphatic hydrocarbon radical containing 1 to about 22 carbon atoms or a mixture of various such radicals, $R^2$ is a hydrogen atom or a lower alkyl group containing 1 to 6 carbon atoms, $R^3$ is a linear or branched, saturated or unsaturated, aliphatic, optionally aryl-substituted, acyclic or cyclic hydrocarbon radical containing 1 to about 78 carbon atoms and optionally one or more hydroxy groups and/or ether groups —O— or a mixture of various such radicals, p is a number of 0 to about 15 and q is a number of 0 to about 50, the sum of p and q being at least 1, more particularly epoxy-end-capped polyalkoxylated alcohols corresponding to the above formula, in which $R^1$ is a linear aliphatic hydrocarbon radical containing about 4 to about 18 and preferably about 4 to about 12 carbon atoms, more particularly a butyl, hexyl, octyl or decyl radical or mixtures thereof, or a mixture of various such radicals, $R^2$ is a hydrogen atom or a lower alkyl group containing 1 to 6 carbon atoms, preferably a hydrogen atom, $R^3$ is a group $[CH_2CH(R^4)O]_rH$, where $R^4$ is a linear aliphatic hydrocarbon radical containing about 2 to about 26, preferably about 4 to about 18 and more preferably about 6 to about 14 carbon atoms or a mixture of various such radicals and r is a number of 1 to about 3, preferably 1 to about 2, more preferably 1, p is a number of 1 to about 5, preferably 1 to about 2 and more preferably 1 and q is a number of 1 to about 30, preferably about 4 to about 26 and more preferably about 10 to about 24, for example with $R^1=C_{8/10}$ alkyl group, $R^2=H$, $R^3=[CH_2CH(R^4)O]_rH$ with $R^4=C_8$ alkyl group and r=1, p=1 and q=22, (iv) lignin sulfonates, for example the alkali metal and alkaline earth metal lignin sulfonates and the ammonium lignin sulfonates or mixtures thereof, preferably sodium, magnesium, calcium or ammonium lignin sulfonates and mixtures thereof, more particularly the sodium lignin sulfonates, and/or lignin sulfonic acid optionally neutralized in situ with a corresponding base (suitable lignin sulfonates are commercially obtainable, for example, under the name of Zewa® from Ligninchemie, for example the sodium lignin sulfonates Zewa® EF, Zewa® S, Zewa® S2, Zewa® SL and Zewa® SL 2 and the ammonium lignin sulfonate Zewa® DIS TR, under the name of Totanin® from Nike Baeck Industries GmbH, for example the ammonium lignin sulfonate Totanin® AM 5025-T2 and the calcium lignin sulfonate Totanin® CA 2032, and under the name of Boffesperse® (about 25% of the molecules have a molecular weight above 20,000 g/mole), Borrewell®, Borrebond®, Ultrazine®, Ufoxane® (Ultrazine®, Ufoxane®; about 40% of the molecules have a molecular weight above 20,000 g/mole), Marasperse®, Maracell® and Maratan® from LignoTech USA, Inc., the Borregard group, for example the calcium lignin sulfonates Borresperse® CA, Borrebond® and Ultrazine® CA, the sodium lignin sulfonates Borresperse® NA, Boffesperse® 3A, Ultrazine® NA, Ultrazine® NAS, Ufoxane® 2, Ufoxane® 3A and Ufoxane® RG, the ammonium lignin sulfonate Borresperse® NH and the chromium, ferrochromium and iron lignin sulfonates Borresperse® C, FC and FE, (v) gum arabic, (vi) polyvinyl pyrrolidones and (vii) polyethylene glycols, the polywaxes, solid polyethylene glycols with a molecular weight of ca. 500 to >100,000 g/mole, for example 4,000 g/mole, and a wax-like consistency being preferred to the liquid polyethylene glycols with a molecular weight of, for example, 200 g/mole.

Suitable surface-active substances for the compositions according to the invention are surfactants, more particularly from the classes of anionic and nonionic surfactants. In one preferred embodiment of the invention, therefore, the composition contains one or more naphthalene sulfonic acid/formaldehyde condensates in combination with one or more other anionic and/or nonionic surfactants. The compositions preferably contain anionic and nonionic surfactants.

The quantity of anionic surfactant is normally not more than 10% by weight, preferably between 0.01 and 5% by weight, more preferably between 0.01 and 0.5% by weight and most preferably between 0.1 and 0.3% by weight. Where the compositions contain nonionic surfactants, their concentration is normally no higher than 3% by weight, preferably between 0.001 and 0.3% by weight and more preferably between 0.001 and 0.1% by weight.

Preferred anionic surfactants are $C_{8-18}$ alkyl benzenesulfonates, more particularly containing about 12 carbon atoms in the alkyl moiety, $C_{8-20}$ alkane sulfonates, $C_{8-18}$ monoalkyl sulfates, $C_{8-18}$ alkyl polyglycol ether sulfates containing 2 to 6 ethylene oxide units (EO) in the ether moiety and sulfosuccinic acid esters containing 8 to 18 carbon atoms in the alcohol moieties.

The anionic surfactants are preferably used as sodium salts, although they may also be present as other alkali metal or alkaline earth metal salts, for example magnesium salts, and in the form of ammonium or amine salts.

Examples of such surfactants are sodium cocoalkyl sulfate, sodium sec.-alkane sulfonate containing about 15 carbon atoms and sodium dioctyl sulfosuccinate. Fatty alkyl sulfates and fatty alkyl+2 EO ether sulfates containing 12 to 14 carbon atoms, which are preferably used together, have proved to be particularly suitable.

The nonionic surfactants used include, above all, $C_{8-18}$ alcohol polyglycol ethers, i.e. ethoxylated alcohols containing 8 to 18 carbon atoms in the alkyl moiety and 2 to 15 ethylene oxide units (EO), $C_{8-18}$ carboxylic acid polyglycol esters containing 2 to 15 EO, ethoxylated fatty acid amides containing 12 to 18 carbon atoms in the fatty acid moiety and 2 to 8 EO, long-chain amine oxides containing 14 to 20 carbon atoms and long-chain alkyl polyglycosides containing 8 to 14 carbon atoms in the alkyl moiety and 1 to 3 glycoside units. Examples of such surfactants are oleyl cetyl alcohol containing 5 EO, nonylphenol containing 10 EO, lauric acid diethanolamide, cocoalkyl dimethyl amine oxide and cocoalkyl polyglucoside containing on average 1.4 glucose units.

The addition products of ethylene oxide and fatty alcohols containing in particular 2 to 8 ethylene oxide units, fatty acid polyglycol esters (FAE) containing in particular 2 to 10 EO, for example tallow fatty acid+6 EO ester, and alkyl polyglycosides are preferably used as nonionic surfactants; of these nonionic surfactants, representatives containing 8 to 10 carbon atoms in the alkyl moiety and up to 2 glucose units are preferred. Fatty alcohol polyglycol ethers containing in particular 2 to 8 EO, for example $C_{12-14}$ fatty alcohol+4 EO ether, are particularly preferred.

Compositions containing anionic and nonionic surfactant, more particularly combinations of fatty alkyl sulfates and/or fatty alcohol polyglycol ether sulfates with fatty alcohol polyglycol ethers, are particularly preferred.

The cleaning compositions according to the invention may additionally contain water-soluble organic solvents, for example lower alcohols and/or ether alcohols, but preferably mixtures of various alcohols and/or ether alcohols. The quantity of organic solvent is normally not more than 50% by weight, preferably between 0.1 and 30% by weight, more preferably 0.5 and 15% by weight and most preferably between 1 and 10% by weight.

The alcohols used are, in particular, ethanol, isopropanol and n-propanol. Suitable ether alcohols are sufficiently water-soluble compounds containing up to 10 carbon atoms in the molecule. Examples of such ether alcohols are ethylene glycol monobutyl ether, propylene glycol monobutyl ether, diethylene glycol monobutyl ether, propylene glycol monotert.-butyl ether and propylene glycol monoethyl ether, of which ethylene glycol monobutyl ether and propylene glycol monobutyl ether are preferred. If alcohol and ether alcohol are used alongside one another, the ratio by weight between them is preferably from 1:2 to 4:1. If, by contrast, mixtures of two different ether alcohols, more particularly ethylene glycol monobutyl ether and propylene glycol monobutyl ether, are used, the ratio by weight between the two is preferably from 1:6 to 6:1 and more preferably from 1:5 to 5:1, for example 4:1, the proportion of the ether alcohol containing fewer carbon atoms preferably being the higher of the two.

The compositions according to the invention may additionally contain volatile alkali. Ammonia and/or alkanolamines which may contain up to 9 carbon atoms in the molecule is/are preferably used as the volatile alkali. Preferred alkanolamines are the ethanolamines, preferably monoethanolamine. The ammonia and/or alkanolamine content is preferably between 0.01 and 3% by weight, more preferably between 0.02 and 1% by weight and most preferably between 0.05 and 0.5% by weight.

Besides the volatile alkali, the compositions according to the invention may additionally contain carboxylic acid, the equivalent ratio of amine and/or ammonia to carboxylic acid preferably being between 1:0.9 and 1:0.1. Carboxylic acids containing up to 6 carbon atoms, which may be mono-, di- or polycarboxylic acids, are suitable. Depending on the equivalent weight of amine and carboxylic acid, the carboxylic acid content is preferably between 0.01 and 2.7% by weight and more preferably between 0.01 and 0.9% by weight. Examples of suitable carboxylic acids are acetic acid, glycolic acid, lactic acid, citric acid, succinic acid and adipic acid, of which acetic acid, citric acid and lactic acid are preferably used. Acetic acid is particularly preferred.

The composition preferably has a Brookfield viscosity (Model DV-II+, spindle 31, rotation frequency 20 $m^{-1}$, 20° C.) of 0.1 to 200 mPa·s, more preferably in the range from 0.5 to 100 mPa·s and most preferably in the range from 1 to 60 mPa·s. To this end, the composition may contain viscosity regulators. The quantity of viscosity regulator is normally up to 0.5% by weight, preferably between 0.001 and 0.3% by weight, more preferably between 0.01 and 0.2% by weight and most preferably between 0.05 and 0.15% by weight. Suitable viscosity regulators are inter alia synthetic polymers, such as the homopolymers and/or copolymers of acrylic acid and derivatives thereof, for example the products obtainable under the name of Carbopol® from Goodrich, more particularly the crosslinked acrylic acid copolymer Carbopol-ETD-2623®. International patent application WO 97/38076 mentions a number of other polymers derived from acrylic acid which also represent suitable viscosity regulators.

Besides the components mentioned, the compositions according to the invention may contain other auxiliaries and additives of the type typically present in such compositions. These include in particular dyes, perfume oils, pH regulators (for example citric acid, alkanolamines or NaOH), preservatives, complexing agents for alkaline earth metal ions, enzymes, bleaching systems and antistatic agents. The quantity of such additives is normally not more than 2% by weight in the cleaning composition. The lower limit to the quantity used depends on the type of additive and, in the case of dyes for example, may be 0.001 % by weight or lower. The quantity of auxiliaries used is preferably between 0.01 and 1% by weight.

The pH value of the compositions according to the invention may be varied over a broad range, although it is preferably in the range from 2.5 to 12, more preferably in the range from 6 to 11 and most preferably in the range from 7 to 10.5, for example of the order of 7.5 or 10.

The composition according to the invention is sprayable and may therefore be used in a spray dispenser.

Accordingly, the present invention also relates to a product containing a composition according to the invention and a spray dispenser.

The spray dispenser is preferably a hand-operated spray dispenser, more particularly selected from the group consisting of aerosol spray dispensers, self-pressure-generating spray dispensers, pump spray dispensers and trigger spray dispensers, more particularly pump spray dispensers and trigger spray dispensers with a container of transparent polyethylene or polyethylene terephthalate. Spray dispensers are described in more detail in WO 96/04940 (Procter & Gamble) and the U.S. patents cited therein on the subject of spray dispensers, to which reference is made in this connection and of which the disclosure is hereby incorporated in the present application.

The compositions according to the invention are used, for example, by applying the composition to the surface to be cleaned in quantities of about 1.5 to 10 g per $m^2$ and, more particularly, 3 to 7 g per $m^2$ and immediately wiping the surface with a soft absorbent material and thus cleaning and/or disinfecting or sanitizing the surface. The compositions are preferably applied by suitable spray applicators, more particularly a spray dispenser or a product according to the invention, in order to obtain uniform distribution. Sponges or cloths in particular are suitable for wiping and may be periodically rinsed out with water in the cleaning of relatively large surfaces.

The compositions according to the invention are preferably formulated ready for use. According to the invention, the compositions may also be formulated as a concentrate to be diluted accordingly before use, in which case the ingredients are present in concentrations in the upper regions of the particular quantity ranges mentioned.

The compositions according to the invention may be prepared by mixing directly from their raw materials, subsequent intermixing and, in a final step, leaving the composition to stand until it is free from bubbles.

EXAMPLES

Compositions E1 to E3 according to the invention and comparison composition C0 were prepared simply by stirring the components listed in Table 1 together. E1 to E3 contained the naphthalene sulfonic acid/formaldehyde condensate Lomar® LS in various quantities in accordance with the invention whereas C0 contained no additive. All the compositions had a pH value of 7.5 and were both clear and colorless.

TABLE 1

| Composition [% by weight] | E1 | E2 | E3 | C0 |
|---|---|---|---|---|
| Naphthalene sulfonic acid/ formaldehyde condensate | 0.1 | 0.2 | 0.4 | — |
| Cocofatty alcohol sulfate sodium salt | 0.25 | 0.25 | 0.25 | 0.25 |
| $C_{12-18}$ fatty alcohol + 7EO ether | 0.01 | 0.01 | 0.01 | 0.01 |
| Ethylene glycol monobutyl ether | 5 | 5 | 5 | 5 |
| Perfume | 0.1 | 0.1 | 0.1 | 0.1 |
| Water | to 100 | to 100 | to 100 | to 100 |

Testing of anti-film and anti-rain effect

First, quantities of 2 ml of the particular composition were applied to a mirror measuring 30 cm×60 cm using a folded nonwoven measuring 20 cm×20 cm (Chicopee, Duralace 60), after which the mirror was polished in the usual way. After 30 minutes, a second identical treatment was carried out. Another 30 minutes later, the anti-film effect and anti-rain effect were tested as follows.

Anti-film effect. The treated mirror was held for 5 seconds over a bowl (28 cm×50 cm×4 cm) containing 1.5 liters of boiling water and was evaluated immediately afterwards to determine whether it was covered with film and, if so, how thick the film was.

Anti-rain effect. Ca. 10 g of test rain prepared from tap water and 8 g/l of wfk-carpet pigment soil (55% by weight kaolin, 43% by weight quartz, 1.5% by weight lamp black (Flammruβ 101), 0.5% by weight iron oxide black; wfk-Code wfk-09 W) of the wkf-Testgewebe GmbH (http://www/wkf.de) were uniformly sprayed onto the pretreated mirror surface over a period of about 4 seconds from a pump spray bottle. Immediately afterwards, evaluations were made of wetting and droplet formation and—after drying—soil distribution and stain formation.

The evaluation was made visually by a panel of five people who were each instructed to award scores of 1 to 4 to the four compositions in order of decreasing effectiveness. The particular average value is shown as a score in Table 2 together with an assessment. The lower the score, the better the particular effect.

TABLE 2

| Effect Composition | Score | Assessment |
|---|---|---|
| Anti-film effect | | |
| E1 | 3 | Little effect |
| E2 | 2 | Good protection against film formation |
| E3 | 2 | Good protection against film formation |
| C0 | 4 | No anti-film effect |
| Anti-rain effect | | Overall impression of the wet mirror |
| E1 | 2.5 | Good wetting, few droplets |
| E2 | 1.7 | Very good wetting, hardly any droplets |
| E3 | 1.7 | Very good wetting, hardly any droplets |
| C0 | 4.0 | Good wetting, breaks up quickly |
| Anti-rain effect | | Overall impression of the dry mirror |
| E1 | 3.0 | Slightly better soil distribution than C0 |
| E2 | 2.2 | Soil uniformly distributed, hardly any stains |
| E3 | 2.0 | Soil uniformly distributed, no stains |
| C0 | 4.0 | Some stains and "drainage marks", soil only uniform in the upper part |

In contrast to C0, compositions E1 to E3 according to the invention show both an anti-rain effect and an anti-film effect.

Similarly to compositions E1 to E3 according to the invention, comparison compositions C1 to C3 were prepared with the polymer poly(sodium-p-styrene sulfonate) known as an anti-rain additive (see Table 3) on the basis of C0 as starting formulation. These compositions also had a pH value of 7.5 and were both clear and colorless.

TABLE 3

| Additive [% by weight] | C1 | C2 | C3 |
|---|---|---|---|
| Poly(sodium-p-styrene sulfonate), 70,000 g/mole | 0.1 | 0.2 | 0.4 |

Compositions C1 to C3 were also tested for their anti-film effect as described above.

In contrast to compositions E1 to E3 according to the invention, however, compositions C1 to C3 had no anti-film effect.

What is claimed is:

1. An aqueous composition, having a pH of from 6 to 12 , for cleaning hard surfaces and to reduce at least one of a rain effect and a film effect comprising:

(a) 0.001% to 20% by weight of napthalene sulfonic acid/formaldehyde condensates;

(b) 0.01% to 10% by weight of at least one anionic surfactant other than naphthalene sulfonic acid/formaldehyde condensate;

(c) 0.001% to 3% by weight of at least one nonionic surfactant;

(d) 0.1% to 50% by weight of at least one water soluble organic solvent selected from the group consisting of lower alcohols and lower ether alcohols;

(e) optionally at least one member selected from the group consisting of monocarboxylic acids, dicarboxylic acids, polycarboxylic acids each containing up to six carbon atoms, viscosity regulators, dyes, perfume, pH regulators, preservatives, complexing agents for alkaline earth metal ions, enzymes, bleaching systems, antistatic agents, volatile alkali and additives, other than the naphthalene sulfonic acid/formaldehyde condensates, which reduces at least one of the rain effect and the film effect; and (f) water.

2. The composition as claimed in claim 1 containing at least one naphthalene sulfonic acid/formaldehyde condensate in a quantity of 0.01 to 10% by weight.

3. The composition as claimed in claim 1 wherein the anionic surfactant other than naphthalene sulfonic acid/formaldehyde condensates comprises at least one member selected from the group consisting of fatty alkyl sulfates and fatty alcohol ether sulfates.

4. The composition as claimed in claim 1 containing at least one fatty alcohol polyglycol ether.

5. The composition as claimed in claim 4 wherein the at least one other anionic surfactant comprises at least one member selected from the group consisting of fatty alkyl sulfates, and fatty alcohol ether sulfates.

6. The composition as claimed in claim 1 containing a member selected from the group consisting of mixtures of alcohols, mixtures of ether alcohols and mixtures of alcohols and ether alcohols.

7. The composition as claimed in claim 6, wherein the organic solvent comprises a mixture of ethylene glycol monobutyl ether and propylene glycol monobutyl ether.

8. The composition as claimed in claim 7, wherein the ratio by weight of the two ether alcohols is between 1:6 and 6:1.

9. The composition as claimed in claim 1 containing at least one other additive which also reduces at least one of the rain effect and the film effect.

10. The process for reducing at least one of a rain effect and a film effect on a hard surface which comprises treating the surface with the liquid cleaning composition of claim 1.

11. A spray dispenser containing a composition as claimed in claim 1.

12. The composition of claim 1 containing from 0.05 to 5% by weight of the least one naphthalene sulfonic acid/formaldehyde condensate.

13. The composition of claim 12 containing at least one anionic surfactant selected from the group consisting of fatty alkyl sulfates and fatty alcohol ether sulfates.

14. The composition of claim 4 wherein the anionic surfactant comprises at least one member selected from the group, consisting of fatty alkyl sulfates and fatty alcohol ether sulfates.

15. The composition of claim 6 wherein the water-soluble organic solvent comprises a mixture of members selected from the group consisting of lower alcohols, mixtures of lower alcohols, ether alcohols and mixtures of ether alcohols.

16. The composition of claim 3 wherein the water-soluble organic solvent comprises a member selected from the group consisting of lower alcohols, mixtures of lower alcohols, ether alcohols, mixtures of ether alcohols and mixtures thereof.

17. The composition of claim 16 wherein the water-soluble organic solvent comprises a mixture of ethylene glycol monobutyl ether and propylene glycol monoabutyl ether.

* * * * *